United States Patent [19]

Bradley

[11] 4,017,412

[45] Apr. 12, 1977

[54] BLEACHING COMPOSITION

[75] Inventor: William Jack Bradley, Cincinnati, Ohio

[73] Assignee: The Procter & Gamble Company, Cincinnati, Ohio

[22] Filed: Mar. 27, 1975

[21] Appl. No.: 562,531

[52] U.S. Cl. ..... 252/186; 8/111; 252/90; 252/95; 252/99; 252/187 H

[51] Int. Cl.[2] ..... D06L 3/02; C11D 3/395

[58] Field of Search ..... 252/186, 187 H, 90, 252/95, 99, 316, 317; 8/79, 111

[56] References Cited

UNITED STATES PATENTS

| | | | |
|---|---|---|---|
| 3,684,722 | 8/1972 | Hynam | 252/99 |
| 3,708,260 | 1/1973 | Marshall et al. | 252/316 |
| 3,726,967 | 4/1973 | Vorsatz et al. | 252/186 |
| 3,789,002 | 1/1974 | Weber et al. | 252/316 |
| 3,843,548 | 10/1974 | James | 252/187 H |

FOREIGN PATENTS OR APPLICATIONS

| | | |
|---|---|---|
| 635,620 | 1/1962 | Canada |

*Primary Examiner*—Benjamin R. Padgett
*Assistant Examiner*—Irwin Gluck
*Attorney, Agent, or Firm*—Charles R. Wilson; Jerry J. Yetter; Richard C. Witte

[57] ABSTRACT

Starch-thickened compositions containing particulate peroxygen compounds, especially diperazelaic acid, provide stable, effective compositions especially adapted for use as color-safe fabric bleaches at alkaline pH's, e.g., in laundry baths.

11 Claims, No Drawings

BLEACHING COMPOSITION

BACKGROUND OF THE INVENTION

The present invention encompasses compositions for bleaching fabrics under common laundering conditions. More specifically, starch-thickened compositions containing particulate peroxygen compounds, especially diperazelaic acid, are stable, yet highly effective, color-safe bleaches.

The most familiar method for bleaching fabrics to remove stains, especially in the context of a home laundering operation, is to add an oxidizing bleach directly to the laundering liquor. Liquid chlorine (as hypochlorite) solutions are usually employed, but solid peroxygen bleaches are also commercially available. Such bleaches are widely accepted and convenient in that they are used in the aqueous laundering bath in conjunction with the detergent, and provide the desired bleaching action concurrently with fabric laundering.

Chlorine bleaches can damage colors if not diluted properly before coming in contact with fabrics. Commercially available peroxygen bleaches are safer for use in contact with colored fabrics than chlorine bleaches, but are not as effective for removing stubborn stains. Some peroxygen compounds are potentially as efficacious as chlorine bleaches, but are unstable and have too short a shelf life for home use. Moreover, these latter peroxygen compounds can damage colors, especially if solid particles of the compounds adhere directly to colored fabrics in the presence of but small amounts of water. Under such conditions, localized color damage, or "spotting," , can occur.

It has now been found that highly effective peroxygen compounds can be incorporated into a starch-thickened carrier and used to bleach fabrics in an aqueous laundry bath at alkaline pH's (e.g., in the presence of standard detergents or pre-soaks which provide a pH in the alkaline range). It has further been discovered that the starch-thickened bleaches herein are exceptionally stable from the standpoint of both peroxygen bleach stability and stability of the overall, thickened compositions. Accordingly, the present compositions are characterized by their exceptionally good shelf life. In use, the compositions are added to an alkaline laundry bath, whereupon the peroxygen compound decomposes (presumably, to singlet oxygen) and bleaching ensues.

Importantly, it has been found that, should the undiluted compositions herein inadvertently come in direct contact with fabrics, no substantial visible color damage occurs.

It is an object of this invention to provide effective fabric bleaches which are color-safe.

It is another object herein to provide stabilized, highly effective, yet color-safe peroxygen bleaches designed for through-the-wash fabric bleaching under alkaline pH's.

These and other objects are obtained herein as will be seen from the following disclosure.

The concurrently-filed application of Edwards, et al., Ser. No. 562,530, relates to fabric bleaches thickened with non-starch thickening agents.

The concurrently-filed application of Bradley, et al., Ser. No. 562,528, relates to the use of the instant compositions in combination with a dispenser.

PRIOR ART

The following references generally relate to peroxygen compounds and their use as oxidizing agents and/or bleaches: Canadian Patent 635,620 to H. W. McCune, issued Jan. 30, 1962; British Patent 847,702, issued Sept. 14, 1960; W. E. Parker, et al., J. Am. Chem. Soc., 79, 1929 (1957); E. Searles, "Preparation, Properties, Reactions and Use of Organic Peracids and their Salts," FMC Corp., N.Y. (1964); D. Swern (ed.) "Organic Peroxides", Vol. I, Wiley-Interscience, N.Y. (1970).

U.S. Pat. No. 3,843,548, to R. James, issued Oct. 22, 1974, relates to clay-thickened hypochlorite bleaches. Hydrogen peroxide bleaches thickened with silica gel are known in the hair bleaching art.

SUMMARY OF THE INVENTION

The present invention encompasses stable, color-safe, yet effective fabric bleaching compositions, comprising:

a. an effective amount of a solid, substantially water-insoluble peroxygen compound;
b. an effective amount of a starch thickening agent; and
c. a liquid carrier (most preferably water).

One problem with the use of the more effective solid peroxygen compounds, such as the peroxyacids, as fabric bleaches is their tendency to agglomerate into a pasty mass on contact with water or alkaline detergents. Once formed, the pasty mass can adhere strongly to fabrics even in the presence of substantial amounts of water, and the extremely high, localized concentrations of the peroxygen bleaches will cause undersirable spotting damage to fabric dyes.

The present invention is based on the discovery that substantially water-insoluble, particulate peroxygen compounds can be suspended in a carrier matrix thickened or gelled with starches of the type disclosed hereinafter to provide color-safe fabric bleaches. While not intending to be limited by theory, it appears that the particles of peroxygen bleach are coated by the starch-thickened carrier. As a result of this coating action, the peroxygen compounds do not agglomerate on contact with water or alkaline detergent compositions. Moreover, the carrier matrix physically prevents contact between the fabrics and the bleach particles. Water quickly disperses the thickened composition so that localized spotting does not occur.

Moreover, the peroxygen compounds used herein do not dissolve in water to any substantial extent (below about 110° F); rather, they are decomposed in the presence of base to provide an active oxygen species which performs a fabric bleaching function. Accordingly, the substantially water-insoluble and stable nature of the particulate peroxygen compounds herein (in the absence of base) adds to the color safety and shelf life of the compositions.

DETAILED DESCRIPTION OF THE INVENTION

The instant compositions comprise a solid peroxygen bleach; a starch thickening agent which will provide thickened compositions which retain their integrity on addition to a laundry bath, but which quickly "break" and disperse on agitation of the bath; and a carrier liquid which does not substantially dissolve the solid peroxygen bleach. These ingredients are described, in turn, below.

PEROXYGEN COMPOUND

The peroxygen bleaching agents used in the present compositions can be any of the well-known organic peroxides which are substantially water-insoluble, and which decompose under alkaline conditions to provide active (presumably, singlet) oxygen. (By "substantially water-insoluble" herein is meant a water solubility of less that about 1% wt. at room temperature.) Such organic peroxide materials include, for example, the alkyl, alkenyl, alkynyl, cycloalkyl, cycloalkenyl, aralkyl, aralkenyl and heterocyclic hydroperoxides; the acyclic, cycloalkyl and aralkyl $\alpha$-oxyhydroperoxides and the gem-dihydroperoxides; the cyclic peroxides such as 1,2,4-trioxacyclopentane; the $\alpha$-oxyperoxides; the $\alpha$-oxoperoxides; the $\alpha,\alpha'$-dioxyperoxides and $\alpha,\alpha'$-diperoxyperoxides; the $\alpha,\alpha'$-dioxoperoxides; and the $\alpha,\alpha'$-dialkoxy-$\alpha,\alpha'$-dioxoperoxides, well-known in the scientific literature. For typical listings of such compounds, see ORGANIC PEROXIDES THEIR FORMATION AND REACTIONS, E. G. E. Hawkins, D. Van Nostrand Company, Inc., 1961, incorporated herein by reference.

It is to be understood that the present compositions can be prepared with any of the foregoing types of solid peroxides as the peroxygen bleaching agent, so long as the peroxide selected is substantially water-insoluble and decomposes under alkaline conditions to provide the active oxygen bleaching species. Of course, it will be appreciated that certain organic peroxides are expensive; others are difficult to prepare on a commercial scale; still others are overly toxic or decompose to toxic and/or malodorous or otherwise undesirable by-products. While such factors are not important to the functioning of the present compositions, they must be considered when selecting preferred peroxides for home use as bleaches.

The most highly preferred peroxides for use as the peroxygen bleaching agent in the present compositions are the peroxyacids. Peroxyacids are conveniently prepared by the reaction of carboxylic acids with hydrogen peroxide in the presence of sulfuric acid, and many such materials are commercially available. The peroxyacids, as a class, are quite effective bleaches. In general, peroxyacids containing at least about 8 carbon atoms are sufficiently insoluble in water for use herein. The common alkali metal and ammonium salts of the peroxyacids are, for the most part, too water-soluble and are not used in the instant compositions.

Typical monoperoxyacids (i.e., prepared from monocarboxylic acids) useful herein include alkyl peroxyacids, alkenyl peroxyacids and aryl peroxyacids. Nonlimiting examples of peroxyacids useful herein include peroxymyristic acid, peroxystearic acid, peroxyoleic acid and peroxy-$\alpha$-naphthoic acid.

Typical diperoxyacids (i.e., prepared from dicarboxylic acids) useful herein include alkyl diperoxyacids, alkenyl diperoxyacids and aryl diperoxyacids. Nonlimiting examples of diperoxyacids useful herein include diperazelaic acid, diperbrassylic acid, dipersebacic acid, and diperisophthalic acid. The diperoxyacids are preferred over the monoperoxyacids in that, on a mole basis, the di-acids provide two equivalents of active oxygen, whereas the mono-acids provide one.

Diperazelaic acid can be readily obtained by the reaction of hydrogen peroxide and sulfuric acid with azelaic acid, which, in turn, is obtained by the catalytic oxidation of 9,10-dihydroxystearic acid; see U.S. Pat. No. 3,855,257, issued Dec. 17, 1974, to E. P. Pultinas, Jr., incorporated herein by reference. Diperazelaic acid is preferred for use herein by virtue of its low solubility in water and superior bleaching performance.

The present compositions comprise from about 5% to about 35%, more preferably about 15% to about 25%, by weight of the peroxygen bleaching compound.

THICKENING AGENT

The peroxygen bleaching compositions herein are thickened, or even gelled, and are characterized by a viscosity (Brookfield) in the range of about 200 centipoise (cps) to about 100,000 cps, preferably about 1000 cps to about 20,000 cps.

The thickened bleaches can be prepared by suspending the active bleaching compound in water or any other non-solubilizing liquid carrier, e.g., 95:5 (wt.) waterethanol, or the like, and thickening the suspension with starch. The term "starch" as used herein includes natural and refined starches such as corn (preferred), rice, and wheat starches, as well as various derivatized starches such as starch esters, modified starches and coated starches which are known as thickeners for water and like carrier materials used herein.

More specifically, commercial starches useful herein include the unmodified food grade starches obtained from corn, wheat and rice, as well as tapioca starches, cow soapwort (*Saponaria vaccaria*) starch, potato starch, and the like. Such starches are well known for their swelling and thickening properties and are commercially available as easily used powders.

Derivatized and cross-linked starches are also well known thickening agents and such materials are also useful herein. Acetylated corn, wheat and rice starches, chlorohydrin cross-linked corn, wheat and rice starches and coated starches such as DRY-FLO starch are useful thickeners herein.

The unmodified starches, especially corn starch, are especially preferred herein in that they provide surprisingly stable compositions which disperse readily on agitation of an aqueous laundry bath.

The compositions herein comprise from about 1% to about 25%, more preferably about 8% to about 15%, by weight of the starch thickener. More or less can be employed, depending on the thickening power of the starch selected for use.

It is to be understood that the starch thickeners used herein provide compositions which are substantially more stable than similar compositions prepared from nonstarch thickeners. This is entirely unexpected, since it would have been reasonable to expect that the peroxygen compounds would decompose the starch-thickened carriers used herein and, themselves, be decomposed.

CARRIER

The liquid carrier herein is selected from liquids suitable for use under laundering conditions, and which can be gelled with the starch, but which do not dissolve the solid peroxygen compounds used herein as bleaches. Water is the most highly preferred carrier herein, but other liquids can be employed if they meet the above criteria. The liquid carrier comprises about 40% to 90% by weight the instant compositions.

OPTIONAL COMPONENTS

As in the case of most peroxygen compounds, decomposition of the bleaches herein is catalyzed by "heavy" metal ions. In order to help provide storage-stable compositions, contamination by even trace amounts of metal ions is preferably avoided. Metal ion contaminants can be removed from the instant compositions by the use of effective amounts of various well known chelating agents. However, it is again noted that the starches themselves, especially corn starch, provide exceptionally stable compositions even without resorting to chelating agents.

Typical optional chelating agents useful herein include ethylenediaminetetraacetic acid, and its alkali metal salts; nitrilotriacetic acid, and its alkali metal salts; sodium pyrophosphate; and like chelators well known in the art. For most purposes, from about 0.05% to about 1% of chelator by weight of the composition removes all metal ion contaminants; more or less can be used, depending on the degree of metal ion contamination.

Other optional ingredients which can be used in the instant compositions include effective amounts of various laundry adjunct and fabric treating agents not commonly found in bleaches. Such materials can be used in the present compositions without the problem of undesirable interactions with the active bleaching agent, since the bleaching agent is present in an undissolved state. Typical, optional additives herein can include fumigants, fungicides, soil suspending agents, optical bleaches, disinfectants, and the like, well known in the detergency arts. For most purposes, such optional ingredients will comprise a minor, but effective, amount of the compositions herein, usually from about 0.05% to about 5% by weight.

A particularly desirable attribute of the present compositions is their substantial lack of odor. Again, since the bleaching compounds are in a stable state they do not interact with the complex organic molecules present in desirable odoriferous and perfume compositions. Accordingly, it will be appreciated that the compositions herein can be desirably perfumed and will retain a stable odor throughout their shelf life. This important attribute of the present compositions is to be contrasted with hypochlorite bleaches, which are inherently malodorous and which cannot be effectively perfumed due to oxidative decomposition of perfume components.

Preferred bleaches of the present invention will contain an odoriferous amout, i.e., from about 0.01% to about 5%, preferably 0.05% to about 1%, by weight of a perfume component. The perfume component can comprise a relatively complex mixture of odoriferously desirable components, e.g., jasmine, rose extract, sandalwood oil, and the like. Alternatively, relatively simple perfume ingredients which connote cleansing can be used, e.g., terpene mixtures (pine oil), lemon oil, and the like.

As can be seen from the foregoing, the compositions herein comprising the solid, water-insoluble peroxygen compound, the starch thickening agent, the liquid carrier, and the various optional adjuncts, can be formulated from materials which are readily available. The highly preferred compositions herein are those wherein the peroxygen compound is a peroxyacid, especially diperoxyacids such as diperazelaic acid (most preferred), diperbrassylic acid, dipersebacic acid and diperisophthalic acid. In order for the compositions to be readily dispersed throughout an aqueous, alkaline laundering liquor when used, it is preferred that the solid peroxygen compound be in a fairly fine, granular state, but this is not critical to the practice of the invention. For the most part, the peroxygen compounds have an average particle size below about 1500 microns; most preferably, the diperoxyacids used herein have a particle size below about 1000 microns, generally in the range from about 1 micron to about 1000 microns. Peroxygen compounds which pass a 20 mesh sieve work well herein, as do those which pass a 200 mesh sieve. Highly preferred compositions herein contain from about 5% to about 35% by weight of the peroxygen compound, and most preferably comprise from about 15% to about 25% by weight of a diperoxyacid.

The most highly preferred compositions herein by virtue of their stability and long shelf life comprise from about 20% to about 30% by weight of a particulate diperoxyacid; from about 5% to about 20%, more preferably from about 10% to about 15%, by weight of corn starch; the balance of the composition comprising water, which is a highly preferred liquid carrier herein.

When preparing optimal compositions of the present type, it is most preferred to use diperazelaic acid having an average particle diameter in the range from about 10 microns to about 1000 microns. Such compositions comprising the diperazelaic acid, corn starch thickener, and water carrier also preferably contain an odoriferous amount of a perfume component. Such optimal compositions herein will contain, as an additional component, an effective amount of a metal chelating agent, whereby the compositions are substantially free of heavy metal cations.

The present compositions can be prepared by simply blending the ingredients. In the most preferred method of preparation, the starch thickener is added to the water carrier and blended until a homogeneous system thickened to the desired degree is secured. The peroxygen compound is added, together with any optional ingredients, and the composition is blended until homogeneous. Of course, the compositions are non-alkaline, since alkalinity causes decomposition of the peroxygen compounds.

The following examples illustrate the compositions and processes of the present invention, but are not intended to be limiting thereof.

EXAMPLE I

A bleach composition thickened with a corn starch thickener is as follows.

| Ingredient | % (wt.) |
|---|---|
| Diperazelaic acid* | 15.25 |
| Corn starch | 12.67 |
| Perfume | 0.3 |
| Water | Balance |

*Passes 150, retained on 200 ASTM sieve.

The composition of Example I is prepared by simply mixing the indicated ingredients as noted above until a homogeneous composition having a thick, semigelatinous consistency is secured.

The composition of Example I (2 oz.) is added to a washing machine with ca. 20 gallons of water and 1.25 cups of a commercial, phosphate-built laundry detergent composition. The pH of the laundering bath is ca. 9.5. Colored and white fabrics stained with coffee, tea and wine are placed in the bath.

The washing machine is operated according to manufacturer's instructions, with agitation. The composition of Example I is distributed uniformly throughout the bath by machine agitation and removes substantially all stains from the fabrics during the course of a 14-minute wash. No substantial visible damage to fabric colors is noted. The fabrics are provided with a desirable, perfumed odor.

In the composition of Example I, the diperazelaic acid is replaced by an equivalent amount of diperbrassylic acid, dipersebacic acid and diperisophthalic acid of the same particle size, respectively, and excellent bleaching performance is secured.

In the composition of Example I, the corn starch is replaced by an equivalent amount of wheat starch, rice starch, potato starch and tapioca starch, respectively, and equivalent results are secured.

EXAMPLE II

A bleach composition with a chelating agent is as follows.

| Ingredient | % (wt.) |
|---|---|
| Diperazelaic acid* | 15.25 |
| Corn starch | 12.67 |
| Ethylenediaminetetraacetate, sodium salt (EDTA) | 0.5 |
| Water | Balance |

*Passes 20, retained on 200 ASTM sieve.

The composition of Example II is prepared by mixing the water, corn starch, and ethylenediaminetetraacetate until a syrupy consistency is achieved. The particulate diperazelaic acid is thereafter added, and stirring is continued until a homogeneous system is secured.

The composition of Example II is employed in the same manner as that of Example I, above, to bleach fabrics. Excellent stain removal performance without substantial visible color damage is secured.

In the composition of Example II, the EDTA is replaced by an equivalent amount of trisodium nitrilotriacetate and a stable, color-safe fabric bleach is secured.

A composition of the above type can optionally be adjusted to an acidic pH (preferably pH 5–6) with hydrochloric acid, citric acid, $KH_2PO_4$, or the like, to further stabilize against decomposition.

The compositions of Examples I and II, above, can be placed directly on colored fabrics, without substantial visible color damage. The compositions are characterized by the exceptional stability of both the thickened carrier matrix and the active peroxygen bleach.

What is claimed is:

1. A fabric bleaching composition having a viscosity of from about 200 cps to about 100,000 cps, comprising:

a. from about 5% to about 35% by weight of a solid, substantially water-insoluble peroxygen compound selected from the group consisting of diperazelaic acid, diperbrassylic acid, dipersebacic acid, and diperisophthalic acid;

b. an effective amount of a starch thickening agent; and c. the balance a liquid carrier.

2. A composition according to claim 1 wherein the starch thickening agent represents from about 1% to about 25% by weight of the composition.

3. A composition according to claim 2 wherein the composition has a viscosity of from about 1000 cps to about 20,000 cps.

4. A composition according to claim 1 wherein the diperoxyacid is characterized by an average particle diameter below about 1500 microns.

5. A composition according to claim 1 wherein the thickening agent is selected from corn, wheat, rice, potato and tapioca starches, and derivatives thereof.

6. A composition according to claim 5 wherein the thickener is corn starch and comprises from about 5% to about 20% of the composition.

7. A composition according to claim 1 wherein the liquid carrier is water.

8. A composition according to claim 1 wherein the diperoxyacid is diperazelaic acid.

9. A composition according to claim 8 containing, as an additional component, an odoriferous amount of a perfume component.

10. A composition according to claim 9 containing, as an additional component, an effective amount of a metal chelating agent, whereby the composition is substantially free of heavy metal cations.

11. A composition according to claim 10 which is in the non-alkaline pH range.

* * * * *